US011843191B2

(12) United States Patent
Bock et al.

(10) Patent No.: US 11,843,191 B2
(45) Date of Patent: Dec. 12, 2023

(54) SOLDERING AID AND METHOD FOR ATTACHING A CABLE TO A CONDUCTOR AREA

(71) Applicant: MD ELEKTRONIK GmbH, Waldkraiburg (DE)

(72) Inventors: Daniel Bock, Schoenberg (DE); Christian Stoemmer, Erding (DE); Nikolaus Lechleitner, Ampfing (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 29 days.

(21) Appl. No.: 17/364,904

(22) Filed: Jul. 1, 2021

(65) Prior Publication Data

US 2022/0029321 A1 Jan. 27, 2022

(30) Foreign Application Priority Data

Jul. 23, 2020 (DE) ..... 10 2020 119 423.4

(51) Int. Cl.
*H01R 12/53* (2011.01)
*H01R 43/02* (2006.01)
*H01R 12/57* (2011.01)

(52) U.S. Cl.
CPC ..... *H01R 12/53* (2013.01); *H01R 12/57* (2013.01); *H01R 43/0235* (2013.01); *H01R 43/0263* (2013.01)

(58) Field of Classification Search
CPC ..... H01R 12/51; H01R 12/53; H01R 12/57; H01R 12/75
See application file for complete search history.

(56) References Cited

U.S. PATENT DOCUMENTS 3,573,719 A * 4/1971 Lightner ..... H01R 12/777 439/494
3,748,631 A * 7/1973 Brorein ..... H01R 12/722 439/633
5,021,630 A 6/1991 Benko et al.
5,499,448 A * 3/1996 Tournier ..... H01R 4/183 29/862
6,338,653 B1 * 1/2002 Jones ..... H01R 12/598 439/579
9,614,306 B2 * 4/2017 Hewer ..... H01R 12/515
(Continued)

FOREIGN PATENT DOCUMENTS

DE 10046489 C1 12/2001
DE 10350490 B3 8/2005
(Continued)

*Primary Examiner* — Chau N Nguyen
(74) *Attorney, Agent, or Firm* — LEYDIG, VOIT & MAYER, LTD.

(57) ABSTRACT

A soldering aid for electrically conductively connecting a cable core of a cable to a conductor area includes a body made of an electrically insulating material and an electrically conductive contact part received in the body. The contact part has a contact surface configured to electrically conductively contact the conductor area. The body is formed with a receptacle having a slot open toward one side configured to receive the cable core of the cable, and is formed with a through-bore configured to surround a sheathed portion of the cable. The contact part closes an opening at a bottom of the slot and conductively contacts the cable core.

27 Claims, 3 Drawing Sheets

(56) References Cited

U.S. PATENT DOCUMENTS

| | | | | |
|---|---|---|---|---|
| 9,985,362 | B2 * | 5/2018 | Arenburg | H01R 4/30 |
| 2005/0106932 | A1 | 5/2005 | Miyazawa | |
| 2010/0159737 | A1 * | 6/2010 | Elsaesser | H01R 4/2483 439/416 |
| 2012/0250310 | A1 * | 10/2012 | Hussell | H01L 25/0753 174/79 |
| 2014/0138154 | A1 | 5/2014 | Sugiyama | |
| 2019/0157780 | A1 * | 5/2019 | Lueckemeier | H01R 12/515 |
| 2021/0257751 | A1 * | 8/2021 | Henrici | H01R 12/515 |

FOREIGN PATENT DOCUMENTS

| | | | | |
|---|---|---|---|---|
| DE | 102008013226 | A1 | | 9/2009 |
| DE | 102011076817 | A1 | | 12/2012 |
| DE | 102013215145 | A1 | | 2/2015 |
| EP | 3477798 | A1 | | 5/2019 |
| JP | 2015-072824 | | * | 4/2015 |
| WO | WO 2009114225 | A1 | | 9/2009 |

* cited by examiner

SOLDERING AID AND METHOD FOR ATTACHING A CABLE TO A CONDUCTOR AREA

CROSS-REFERENCE TO PRIOR APPLICATION

This application claims benefit to German Patent Application No. DE 10 2020 119 423.4, filed on Jul. 23, 2020, which is hereby incorporated by reference herein.

FIELD

The invention relates to the field of attaching the cable core of a cable to a conductor area in the form of, for example, an electrically conductive contacting surface (called solder pad) on a printed circuit board. The attachment of the electrically conductive cable core to the contacting surface may be made, in particular, by a solder connection, where a solder melted and solidified in a defined manner contacts the cable core of the cable as well as the contacting surface of the conductor area, thereby mechanically and electrically conductively connecting the same. The printed circuit board may be part of a connector of a cable or part of a control unit.

One of the requirements occurring in practice is to position and attach a large number of cable cores having as small a cross-sectional area as possible (e.g., about 0.10 $mm^2$ or less) to correspondingly small contacting surfaces with high positioning accuracy. A further frequent requirement is to position and attach several cable cores to the respective contacting surfaces at a defined distance from one another.

BACKGROUND

U.S. Pat. No. 5,021,630 A describes attaching an electronic device to a substrate using a glass plate that is heated under the influence of a laser so that a solder on the cable core of the electronic device melts.

DE 10 2008 013 226 A1 describes attaching an electronic device (SMD) via a contact surface to a solder paste disposed within a recess in the conductor area. The conductor area must be provided with the recess prior to attachment and, moreover, the solder paste is disposed and exposed on the surface of the conductor area.

EP 3 477 798 A1 describes a device for attaching a first cable core in a housing using a pressing mechanism that preliminarily secures the cable core so that a second cable core can also be attached in the housing.

DE 100 46 489 C1 describes, with reference to FIG. 4, the connection of a cable core of a cable having a stripped end to a contact surface, where a single or multi-layer carrier foil is provided between the cable core and a contact piece having teeth. The contact piece is configured as a crimp barrel, and the teeth of the crimp barrel penetrate the carrier foil. Disposed between the teeth in the area between the cable core and the contact surface is a solder deposit which is melted by heating the crimp barrel. In an alternative, the solder deposit is disposed between the carrier foil and the contact piece so that the melted solder has to pass through openings in the carrier foil.

SUMMARY

In an embodiment, the present invention provides a soldering aid for electrically conductively connecting a cable core of a cable to a conductor area includes a body made of an electrically insulating material and an electrically conductive contact part received in the body. The contact part has a contact surface configured to electrically conductively contact the conductor area. The body is formed with a receptacle having a slot open toward one side configured to receive the cable core of the cable, and is formed with a through-bore configured to surround a sheathed portion of the cable. The contact part closes an opening at a bottom of the slot and conductively contacts the cable core.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
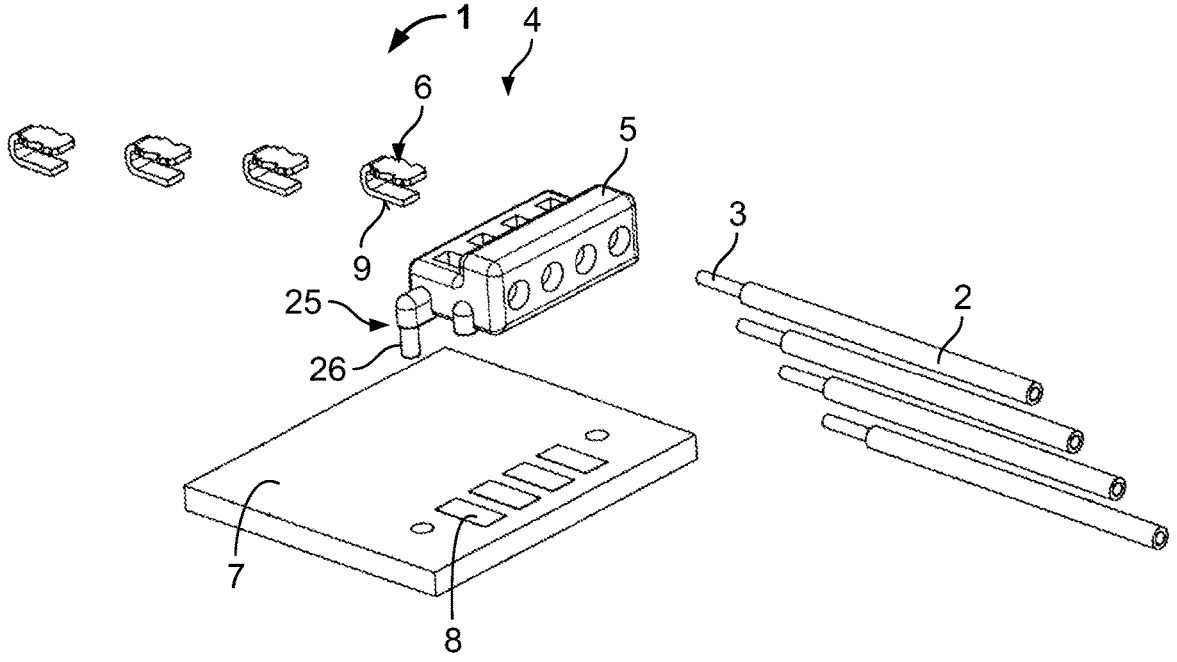
FIG. 1 is a perspective exploded view of an exemplary embodiment of an inventive assembly including four cables, each having a cable core, and an exemplary embodiment of a soldering aid according to the invention.

Embodiments of the present invention provide a way to position a large number of cable cores having an in particular small cross-sectional area on conductor areas.

According to an embodiment of the present invention, an inventive soldering aid has in particular a body made of an electrically insulating material and an electrically conductive contact part received in the body. The contact part has a contact surface for electrically conductively contacting the conductor area, the body being formed with a receptacle having a slot for the cable core of the cable, which slot is open toward one side, and a through-bore surrounding the sheathed portion. The contact part closes an opening at the bottom of the slot and electrically conductively contacts the cable core.

The electrically conductive contact of the cable core to the conductor area is created by the contact part, which is received on or in the electrically insulating body. The body is a flat three-dimensional, and thus easy-to-handle body within which the cable core and the adjoining end portion of the sheath of the cable with the stripped end is received in the region of the receptacle. The slot for the cable core of the cable, which is open toward one side, enables easy control of the cable core and easy feeding of solder, and further enables rapid heat supply and removal for the heating and cooling of the solder. The design of the through-bore that surrounds the sheathed portion of the cable allows easy feeding, alignment and holding of the cable core with respect to the slot and the contact part. The slot has an opening at the bottom of the slot, the opening being closed by the contact part so that the contact part contacts and electrically conductively connects the cable core at the latest when the solder in the slot is solidified and the solder is held in the slot by the contact part.

The soldering aid according to an embodiment of the invention makes it possible to form an assembly from a cable having at least one cable core and a soldering aid. It may be provided, in particular, that two or more cables, each having at least one cable core, be secured to a single soldering aid. In this connection, two or more cables can be accurately positioned in relative alignment with each other in a single process step. The assembly may be formed by permanent attachment of the at least one cable core to the contact part of the soldering aid, for example by the cable core being fixedly connected by the soldered union to the contact part. This permanent assembly may be held available as an intermediate product and utilized as needed for positioning the cable core on the conductor area. Alternatively or additionally, the assembly may be formed by a weak, possibly releasable attachment of the cable core to the soldering aid, such as when the sheath of the cable is held in the sheath-receiving through-bore of the receptacle in a clamping manner; i.e., with slight deformation of the elastic material of the cable sheath. Such clamping reception is achieved in particular when provision is made for the through-bore of the soldering aid to have a diameter that decreases away from an insertion opening. In particular, the through-bore is configured to taper toward the slot, in particular to conically taper along a portion or portions thereof.

The soldering aid also enables performing a method for attaching the cable core of a cable to a conductor area, wherein, in a first step, the above-described assembly is formed from the at least one cable core of the at least one cable, and, in a second step, the at least one contact part of the soldering aid is attached to the conductor area, the attachment of the soldering aid to the conductor area being implementable, for example, by a soldered connection or by an adhesive connection using an electrically conductive adhesive.

Preferably, provision is made for the receptacle of the soldering aid to be disposed substantially parallel to the contact surface of the contact part.

Preferably, provision is made for the slot of the soldering aid to be formed as a longitudinal slot that is open in a direction away from the contact surface, thereby ensuring that the molten solder in the open longitudinal slot cannot reach the conductor area and is held within the slot.

A preferred embodiment provides that the through-bore in the body of the soldering aid have a diameter that decreases away from an insertion opening. In particular, if provision is made for the diameter of the through-bore to decrease linearly with increasing distance away from the insertion opening at least along a portion or portions thereof, then the through-bore tapers conically at least along a portion or portions thereof. This allows the sheath of the cable to be clampingly received in the region of the through-bore, thus making it possible to preliminarily secure the cable, and thus the cable core of the cable, with respect to the slot of the body of the soldering aid.

Preferably, it is further provided that the through-bore have a step. In the region of the step, the diameter of the through-bore is abruptly reduced, so that the sheath edge formed by stripping the cable has an engagement face that rests against the step. During insertion of the stripped cable end, a sensorially easily detectable stop is created, which enables correct positioning of the cable end in the receptacle. Such an automatically detectable stop is advantageous for automated placement of the stripped cable ends in the soldering aid.

Preferably, it is provided that the opening at the bottom of the slot be formed as a longitudinal slot. Due to the extent of the longitudinal slot, an increased area of contact is achieved between the solder and the portion of the contact part that covers the longitudinal slot, so that a reliable electrical contact with the contact surface of the contact part can be achieved even if the cable core is not completely wetted with the melted and solidified solder.

Preferably, it is provided that the contact part be in the form of a profiled sheet-metal blank, it being provided, in particular, that the contact part be substantially U-shaped in profile. A first surface portion of a side surface of the U, for example at one of the legs of the U, covers the bottom of the slot, and a second surface portion of the side surface of the U, for example at the other leg of the U, is designed for contacting the conductor area. As an alternative to configuring the contact part as a substantially U-shaped profiled part, it is provided that the contact part be formed as a flat metal blank. The flat metal blank covers the bottom of the slot with a first surface portion at one side surface and contacts the conductor area with a second surface portion at the other side surface. Configuring the contact part as a flat metal blank offers the advantage of making the soldering aid in particular flat in construction so that the soldering aid has only a small extent in a direction perpendicular to a bottom surface of the body.

Regardless of the specific design of the contact part, it is preferably provided that the contact part have locking hooks, and that the contact part be fixedly secured in the body by means of the locking hooks.

Preferably, it is provided that the body have a bearing surface, and that the contact surface of the contact part be substantially flush with the bearing surface of the body.

Preferably, it is further provided that the body have a first height H in the region of the through-bore and a second height h in the region of the slot, and that first height H be greater than second height h.

In an advantageous embodiment, it is further provided that the body be formed as a single piece, in particular as an injection-molded part.

Furthermore, it is preferably provided that the body be made of a plastic, in particular of a glass fiber-reinforced polyphthalamide.

Furthermore, with regard to the soldering aid, it is preferably provided that the body have a positioning aid projecting beyond the contact surface. The positioning aid may include, for example, at least one, preferably two or more, tapered pins which engage in positioning receptacles in the region of the printed circuit board near the conductor area, and which facilitate the positioning of the soldering aid, in particular of the contact part, with respect to the conductor area on the printed circuit board through engagement of the at least one pin in the positioning receptacles. The tapered pins may have a circular or elliptical cross section, and thus may be cylindrical or conically tapered. Alternatively, the pins may also be rectangular, in particular square, or more generally polygonal in cross section and, in particular, may be tapered toward one end. In particular, the body is provided with a positioning aid that includes at least two spaced-apart pins, the at least two pins being part of a four-point support. In a specific embodiment of the soldering aid, two spaced-apart pins of the positioning aid and two bearing-surface portions which are spaced from each other and from the pins together form a four-point support.

Further advantages and features of embodiments of the invention will be apparent from the description of a preferred exemplary embodiment.

Embodiments of the invention will now be described and explained in greater detail with reference to the accompanying drawing(s).

FIG. 1 shows a unit 1 including an assembly 10 of at least one, namely four, cables, each having exactly one cable core. Only one of the four cables is identified by reference numeral "2," and the cable core of the cable 2 is identified by reference numeral "3." Assembly 10 further includes a soldering aid 4, which includes a body 5. In the exemplary embodiment shown, soldering aid 4 further includes four contact parts, each associated with a particular cable core of one of the four cables, only one of the contact parts being identified by reference numeral "6." Each of the similarly configured contact parts has a contact surface, only the contact surface of contact part 6 being identified by reference numeral "9." Assembly 10 further includes a conductor area 7 in the form of a printed circuit board (PCB), the conductor area 7 having four contacting surfaces, called soldering pads, formed thereon, of which only one is identified by reference numeral "8."

A method for attaching cable 2 to conductor area 7 provides that, in a preliminary step, the at least one contact part 6 is secured in body 5 so that soldering aid 4 is formed. After this preliminary step, the assembly 10 of the at least one cable 2 having the at least one respective cable core 3 and the soldering aid 4 is produced in a first step. To this end, cable core 3 is at least provisionally fixed to soldering aid 4, so that the assembly 10 of the cable core and soldering aid 4 is, as a whole, capable of being handled in an automated manner. In the exemplary embodiment shown, all cable cores of each of the cables are fixed in the common soldering aid 4, and more specifically with a defined spacing therebetween, which is determined by the spacing of contacting surfaces 8 on conductor area 7. In a second step, the assembly 10 of the at least two, in particular four, cable cores of the four cables is attached to conductor area 7 by attaching the respective contact surface 9 of the respective contact part 6 to the associated contacting surface 8. The second step of attaching contact part 6 of soldering aid 4 to conductor area 7 is then performed, for example, in a reflow soldering step and in such a way that each of the contact surfaces 9 is attached to the associated contacting surface 8 by the final reflow soldering step.

The cable core 3 of the respective cable 2 has, in particular, only a small cross-sectional area of about 0.14 $mm^2$ or less and is intended for signal transmission to the printed circuit board of a control unit.

Figure 2:
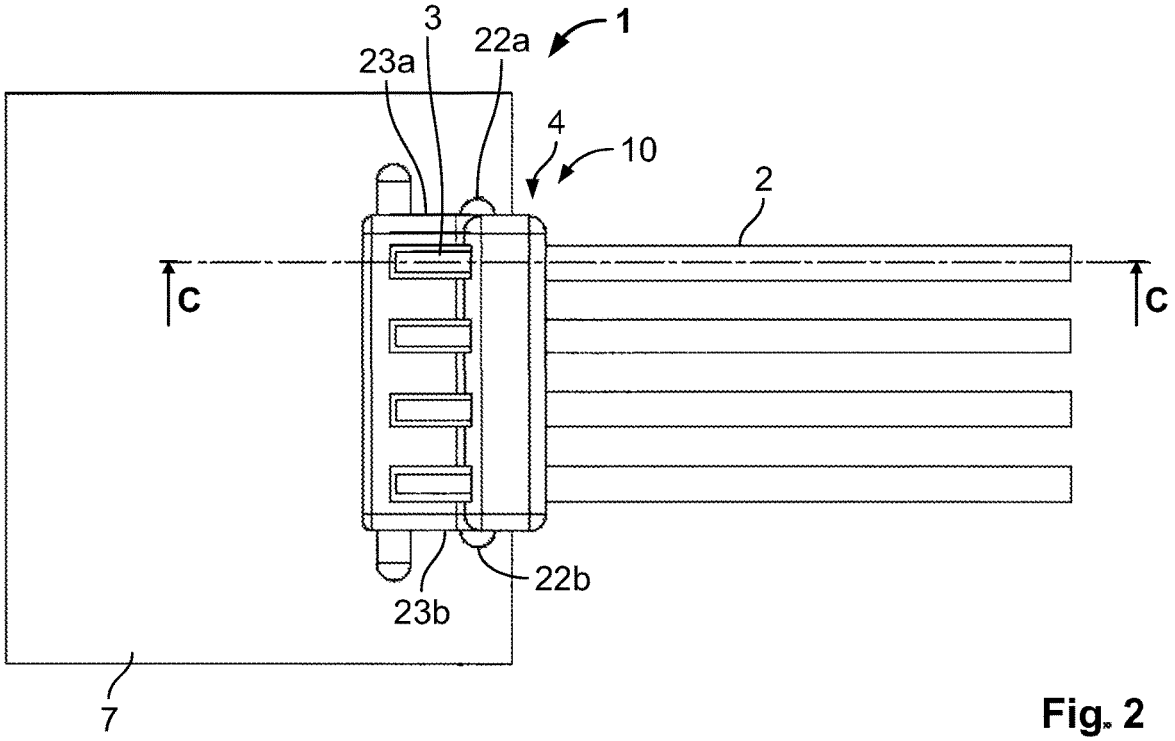
FIG. 2 is a top view showing the assembly and the soldering aid after the method according to the invention has been carried out by way of example.

FIG. 2 shows a top view of the completed unit 1, including the assembly 10 of soldering aid 4 and cable cores 3 of cables 2. When arranged as shown, at the latest, the respective cable core 3 is finally attached to soldering aid 4 by cable core 3 being mechanically fixedly and electrically conductively connected to soldering aid 4 by a soldered union after solidification of the supplied melted and liquefied solder.

Figure 5:
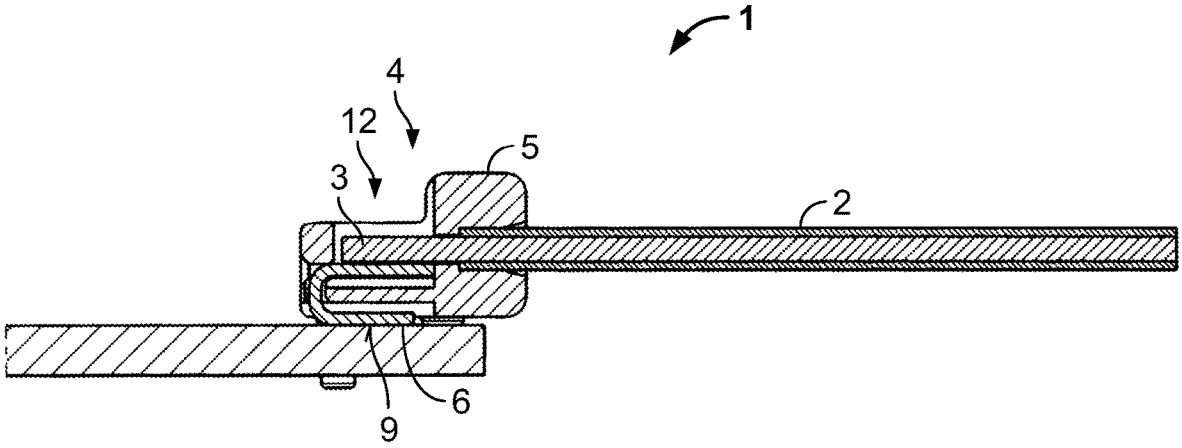
FIG. 5 is a sectional view taken along section line C-C in FIG. 2.

FIG. 5 shows a longitudinal section through unit 1, in particular assembly 10 and conductor area 7.

Soldering aid 4 is designed for mechanically and electrically conductively connecting cable core 3 of cable 2 to contacting surface 8 of conductor area 7.

Soldering aid 4 includes the body 5 made of an electrically insulating material and is made in particular of a plastic material, namely of a glass fiber-reinforced polyphthalamide. Body 5 is formed as a single piece, namely as an injection-molded part. In particular, body 5 is formed as a three-dimensional flat and stepped molded plastic part and is provided as such.

Soldering aid 4 further includes the contact part 6 made of an electrically conductive material. Contact part 6 is manufactured and provided separately from body 5, but is disposed in body 5 and captively secured to body 5.

Figure 3:
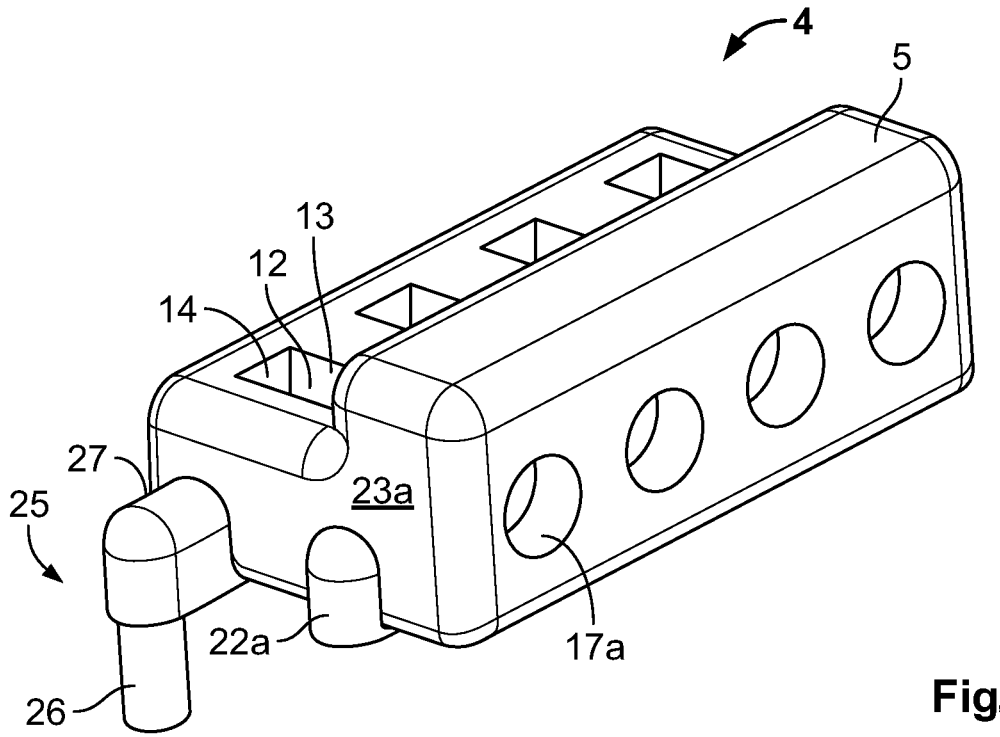
FIG. 3 is a perspective view of the soldering aid of FIG. 1 and FIG. 2.
Figure 4:
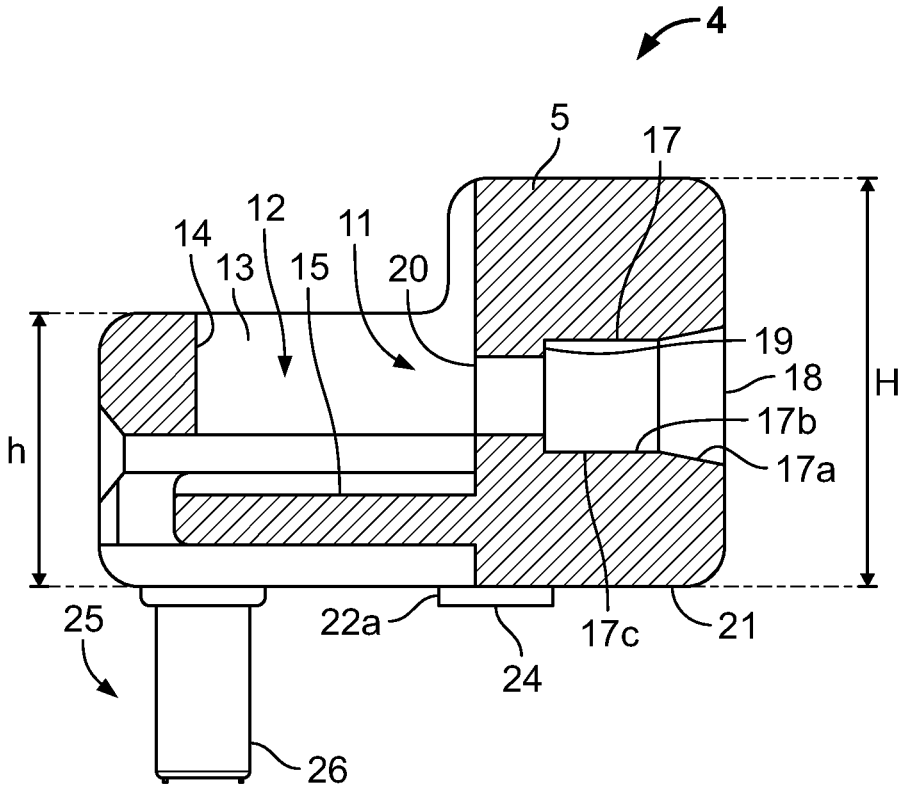
FIG. 4 is a sectional view of the soldering aid of FIG. 1 through FIG. 3.

The body 5 of the soldering aid is shown in FIG. 3 in a perspective view and in FIG. 4 in a longitudinal sectional view.

Body 5 has formed therein a receptacle 11 including two sections which are formed in alignment with each other and merge into each other.

The first section is formed as a slot 12 which is open toward one side. Slot 12 is configured to receive the exposed cable core 3 of cable 2. In particular, the lengthwise extent of slot 12 corresponds substantially to the length along which cable 2 was stripped to expose cable core 3. Slot 12 is bounded laterally by side surfaces 13 and at the end by an end surface 14. Slot 12 is open toward one side, upwardly in the views of FIG. 3 and FIG. 4, and faces away from contacting surface 8. Toward the other side, downwardly in the views of FIG. 3 and FIG. 4; i.e., toward contacting surface 8, slot 12 is only incompletely closed by a bottom 15, leaving an opening 16; i.e., a gap, between bottom 15 of slot 12 and end surface 14 of slot 12. The opening 16 at the bottom 15 of slot 12 is formed as a longitudinal slot which extends transversely to the direction of the longitudinal extent of slot 12. Opening 16 is dimensioned so that by inserting contact part 6, the longitudinal slot is closed so that solder which is received in liquefied form in slot 12 does not directly reach contacting surface 8 of conductor area 7 due to the closure of opening 16 by the insertion of contact part 6.

The extent of slot 12 is more than about 2.5 times the diameter of cable core 3.

Receptacle 11 includes, as a second section, a through-bore 17 which can be seen, in particular, in FIG. 4 and which surrounds the sheathed portion of the cable 3 with the stripped end. Through-bore 17 has a diameter that decreases away from an insertion opening 18.

In a first sub-section 17*a* immediately adjacent to insertion opening 18, a diameter of through-bore 17 decreases substantially linearly with increasing distance away from insertion opening 18 along the longitudinal extent of through-bore 17, so that through-bore 17 tapers conically in the region of the first sub-section.

In a second sub-section 17*b*, through-bore 17 has a substantially constant diameter which is dimensioned so that the diameter of second sub-section 17*b* is slightly smaller than the diameter of the sheath of cable 2, so that in the region of second sub-section 17*b*, the end portion of the sheath of cable 2 is elastically clamped in place under slight deformation thereof. The clamping reception of the end portion of the sheath of cable 2 provides for a slight positional retention, so that cable 2 is fixed in position in body 5 of soldering aid 4 at least to such an extent that cable 2 and soldering aid 4 can be manipulated together.

In a third sub-section 17*c*, through-bore 17 has a reduced diameter compared to second sub-section 17*b*, the transition between the diameters being discontinuous so that through-bore 17 has a step 19. As illustrated in FIG. 5, the sheath edge formed by stripping of the end of cable 2 rests against step 19, so that a stop is sensorially detectable during insertion of the stripped cable end, and the automated insertion movement can be interrupted.

The diameter of third section 17*c* of the through-bore is smaller than the diameter of the sheath of cable 2, but larger than the diameter of the cable core 3 of cable 2, so that cable core 3 is received with some play in third section 17*c*.

When inserting the stripped end portion of cable 2, the exposed cable core 3 is received in a centered manner in the region of the conically tapered first sub-section 17*a* of through-bore 17; the end portion of the sheath of cable 2 adjoining the sheath edge is clampingly held in the region of second sub-section 17*b*, the sheath edge engaging step 19 at the transition from second sub-section 17*b* to third sub-section 17*c*. In particular, the longitudinal extents of slot 12 and through-bore 17 are dimensioned and matched to one another in particular so that when cable core 3 is in this insertion position, it is completely received in slot 12 and maintains a clearance to end surface 14 of slot 12.

In a modification of the aforedescribed exemplary embodiment, it may be provided that through-bore 17 be configured such that the conically tapered first sub-section merges directly into the third sub-section of reduced diameter, so that step 19 is formed directly between the first and third sub-sections.

With regard to the term "through-bore," it is noted that this term does not necessarily mean that the bore is formed by a material-removal process. Rather, the term "through-bore" refers generally to a void space in the material that has an exit opening 20 in addition to insertion opening 18. Such a through-bore can be formed in an injection-molding process by suitable placeholders.

In the exemplary embodiment described above, in the region of exit opening 20, through-bore 17 merges directly into slot 12, which is adjacent thereto in the insertion direction.

Body 5 of soldering aid 4 further includes two formations 22*a*, 22*b*, each formed directly on a respective one of the two short side surfaces 23*a*, 23*b* (FIG. 2). As illustrated in FIG. 3, the two formations 22*a*, 22*b* are each cylindrical in shape and project beyond a substantially flat bottom surface 21 of body 5 by the same amount (FIG. 4), so that two flat bearing surfaces are formed, one of which is identified by reference numeral 24 in FIG. 4. Body 5 rests via the respective contact surfaces 24 on the surface of conductor area 7.

Body 5 further includes a positioning aid 25 including two pins 26 which are each cantilevered from a respective one of the side surfaces 23*a*, 23*b* by a side arm 27 and extend beyond the plane of bottom surface 21 by such an amount that when body 5 is in the mounted position (FIG. 5), each of the pins 26 is engaged in an associated positioning receptacle in conductor area 7 and extends through conductor area 7 (FIG. 1 and FIG. 5). The two pins 26 and the two bearing surfaces 24 at the two side surfaces 23*a*, 23*b* of body 5 together form a four-point support which enables correct alignment and positional retention during the mounting of body 5 on conductor area 7.

FIG. 4 further shows that body 5 has a first height H in the region of through-bore 17 and a second height h in the region of slot 12, first height H being greater than second height h. The heights H, h are relative to the plane of the flat bottom surface 21 of body 5. Body 5 may be formed as a single piece in particular in an injection-molding process by selecting suitable placeholders. In this case, the design of slot 12, which is open toward one side, does not require subsequent material removal.

In the exemplary embodiment shown, the respective contact part 6 is U-shaped in profile (FIG. 1, FIG. 5). When contact part 6 is in an installed position, bottom 15 of slot 12 is received between the legs of the U. Contact part 6 closes the opening 16 in bottom 15 of slot 12. Contact surface 9 of contact part 6 is formed by a portion of the outer surface of the first leg of contact part 6 and, further, the bottom 15 of the slot is covered by a portion of the outer surface of the second leg of contact part 6, so that the cable core 3 in slot 12 comes into contact with contact part 6, and contact part 6 provides an electrically conductive connection between cable core 3 and contacting surface 8.

In a departure from the exemplary embodiment shown, in which contact part 6 has a substantially U-shaped profile as viewed from the side, in a modification of the exemplary embodiment, the contact part 6 may have a substantially Z-shaped profile as viewed from the side.

Contact part 6 is in the form of a profiled sheet-metal blank which is provided as a flat metal blank of suitable outline and bent into the sectional shape. The outline of the metal blank is shaped such that contact part 6 has locking hooks, and that contact part 6 is fixedly secured in body 5 by means of the locking hooks. In the case of the contact part shown in FIG. 1, the locking hooks are formed as opposite teeth on the outer edge of the first leg. When the contact part is in the installed position, the teeth are engaged in recesses at the transition edge of side wall 13 of slot 12 to bottom 15 of slot 12. In particular, the locking hooks configured as teeth may cut and claw into the material of body 5.

In a modification of the exemplary embodiment shown, it is provided that the contact part be formed as a flat metal blank, whereby the flat metal blank closing an opening in the bottom of the slot. The face of the metal blank that faces the slot provides the contact to the cable core, and the opposite face of the metal cutting blank, which faces away from the slot, provides the contact to the contacting surface of the conductor area. Configuring the contact part as a flat metal blank in particular allows the body to be made flat.

It is further apparent from FIG. 5 that receptacle 11 is disposed substantially parallel to contact surface 9 of contact part 6, so that cable 2 can be soldered in a substantially straightened position, aligned parallel to the surface of conductor area 7.

With regard to the illustrated exemplary embodiment, FIG. 5 further shows that the amount by which the respective bearing surfaces 24 of body 5 project beyond bottom surface 21 is selected such that contact surface 9 of contact part 6 is substantially flush with an imaginary extension of the plane of bearing surface 24 of body 5.

Starting from the position shown in FIGS. 2 and 5, in which cable core 3 is received in slot 12, a molten solder is introduced into slot 12. The solidified solder establishes a conductive connection to contact part 6 and fixedly and captively secures cable core 3 in slot 12 on the body 5 of soldering aid 4.

Since slot 12 is formed open toward one side, cable core 3 is easily accessible to solder and, at the same time, cable 2 is securely fixed in place in through-bore 17. Furthermore, since slot 12 is formed open toward one side, the covering of cable core 3 with solder can be performed in a controlled manner and the removal of heat during solidification of the solder is easier to achieve. Moreover, heat for liquefying the solder in slot 12 can be very accurately delivered to the desired location, so that the soldering process can be performed with little thermal strain.

In addition to the exemplary embodiment described above, it may further be provided that soldering aid 4 include a solder deposit, the solder deposit being provided in particular in the region of slot 12. In this case, the attachment of cable core 3 to contact part 6 no longer requires that the solder be supplied externally. The solder deposit may be melted, for example, by a heat stylus that is approached to slot 12, which is open toward one side.

In the exemplary embodiment described above, it was provided that the opening 16 closed by contact part 6 at the bottom 15 of slot 12 was formed as a longitudinal slot extending transversely to the direction of the longitudinal extent of slot 12. In a modification of the exemplary embodiment, it may be provided that the opening be formed as a longitudinal slot that extends, at least along a portion or portions of its length, along or parallel to the direction of the longitudinal extent of slot 12. In another modification of the above-described exemplary embodiment, it may be provided that the opening at the bottom of the slot be is formed as a simple through-hole, and that the contact part have the shape of a cylindrical or conical pin member that closes the through-hole, the end surfaces of the pin member providing the electrical contact to cable core in the slot and to the conductor area, respectively.

In the exemplary embodiment described above, it was provided that through-bore 17, which surrounds the sheathed portion of the cable 3 with the stripped end, was formed continuously along the entire circular cross section; i.e., that the sheathed portion was received within a cross-sectional contour of through-bore 17 that extended 360° around the entire circumference thereof. In a modification of the aforedescribed exemplary embodiment, it may be provided that the sheathed portion be received in through-bore 17 and indeed be securely held therein, but that the cross-sectional contour of through-bore 17 have an angle of only about 300° or more. Such a modification is particularly flat in construction.

In the exemplary embodiment described above, positioning aid 25, in particular the two pins 26, were formed integrally with the remainder of body 5, namely as formations on body 5. More particularly, pins 26 and side arms 27 were produced as further formations during the injection-molding of body 5. In a modification of the exemplary embodiment shown, it is provided that positioning aid 25, in particular the pins 26 projecting beyond bottom surface 21, be manufactured separately from the body, and that they need not necessarily be made of the same material as the body. In the modified exemplary embodiment, it is provided that positioning aid 25, in particular pins 26, be subsequently mounted, for example, in bores in the body or mountable to the body by means of clips or hooks or other mounting means that utilize mechanical clamping action. In the modified exemplary embodiment, it may also be provided that positioning aid 25 be formed from a material different from that of the body. For example, it may be provided that positioning aid 25 be made of a metal, and that the body be made of a plastic or an injection-moldable ceramic material. If positioning aid 25 includes the pins 26, these pins may be made from a metal, and this metal may in particular be a metal that can be used as solder in case the soldering aid must be fixedly secured to the conductor area by means of an additional soldered connection.

The explanations provided with regard to the figures are merely for the sake of illustration and are not to be construed as limiting.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 unit
2 cable
3 cable core
4 soldering aid
5 body of soldering aid 4
6 contact part
7 conductor area
8 contacting surface (soldering pad) of conductor area 7
9 contact surface of contact part 6
10 assembly
11 receptacle
12 slot
13 side surface of slot 12
14 end surface of slot 12
15 bottom of slot 12
16 opening
17 through-bore
17*a* first sub-section of the through-bore
17*b* second sub-section of the through-bore
17*c* third sub-section of the through-bore
18 insertion opening of through-bore 17
19 step
20 exit opening
21 bottom surface
22*a* first formation
22*b* second formation
23*a* first side surface
23*b* second side surface
24 bearing surface
25 positioning aid
26 pin
27 positioning receptacle

What is claimed is:

1. A soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, wherein the through-bore has, at least in a first sub-section of the through-bore, a diameter that decreases away from an insertion opening, wherein the through-bore has, in at least a second sub-section of the through-bore disposed after the first sub-section in an insertion direction of the cable, a diameter that is smaller than a diameter of the sheathed portion of the cable, and wherein the through-bore has a step from the second sub-section to a third sub-section disposed after the second sub-section in the insertion direction of the cable.

2. The soldering aid as recited in claim 1, wherein the receptacle is disposed substantially parallel to the contact surface of the contact part.

3. The soldering aid as recited in claim 1, wherein the slot is formed as a longitudinal slot that is open in a direction away from the contact surface.

4. The soldering aid as recited in claim 1, wherein the contact part has locking hooks, and wherein the contact part is fixedly secured in the body by the locking hooks.

5. The soldering aid as recited in claim 1, wherein the body has a bearing surface, and wherein the contact surface of the contact part is substantially flush with the bearing surface of the body.

6. The soldering aid as recited in claim 1, wherein the body is made of a plastic.

7. The soldering aid as recited in claim 6, wherein the body is made of a glass fiber-reinforced polyphthalamide.

8. The soldering aid as recited in claim 1, wherein the body has a positioning aid which projects beyond the contact surface.

9. The soldering aid as recited in claim 1, further comprising a solder deposit in a region of the slot.

10. A soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, wherein the through-bore has, at least in a first sub-section of the through-bore, a diameter that decreases away from an insertion opening, wherein the through-bore has, in at least a second sub-section of the through-bore disposed after the first sub-section in an insertion direction of the cable, a diameter that is smaller than a diameter of the sheathed portion of the cable, and wherein the opening at the bottom of the slot is formed as a longitudinal slot having a lengthwise extent corresponding to a length along which the cable was stripped to expose the cable core.

11. The soldering aid as recited in claim 1, wherein the contact part is in the form of a profiled sheet-metal blank.

12. The soldering aid as recited in claim 1, wherein the contact part is substantially U-shaped in profile.

13. A soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, wherein the through-bore has, at least in a first sub-section of the through-bore, a diameter that decreases away from an insertion opening, wherein the through-bore has, in at least a second sub-section of the through-bore disposed after the first sub-section in an insertion direction of the cable, a diameter that is smaller than a diameter of the sheathed portion of the cable, and wherein the contact part is formed as a flat metal blank.

14. A soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, wherein the through-bore has, at least in a first sub-section of the through-bore, a diameter that decreases away from an insertion opening, wherein the through-bore has, in at least a second sub-section of the through-bore disposed after the first sub-section in an insertion direction of the cable, a diameter that is smaller than a diameter of the sheathed portion of the cable, and wherein the body has a first height H in a region of the through-bore and a second height h in the region of the slot, and wherein the first height H is greater than the second height h.

15. A soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, wherein the through-bore has, at least in a first sub-section of the through-bore, a diameter that decreases away from an insertion opening, wherein the through-bore has, in at least a second sub-section of the through-bore disposed after the first sub-section in an insertion direction of the cable, a diameter that is smaller than a diameter of the sheathed portion of the cable, and wherein the through-bore extends into the slot at a side of the slot that is opposite to an end wall of the slot, and wherein the slot is bounded laterally by side surfaces and at an end of the slot by the end wall, and is open at a top side opposite to the contact part that closes the opening of the slot at the bottom.

16. The soldering aid as recited in claim 15, wherein the opening at the bottom of the slot is formed as a longitudinal slot having a lengthwise extent that extends from below the end wall to the side of the slot that is open to the through-bore.

17. An assembly comprising:

a soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, wherein the through-bore has, at least in a first sub-section of the through-bore, a diameter that decreases away from an insertion opening, and wherein the through-bore has, in at least a second sub-section of the through-bore disposed after the first sub-section in an insertion direction of the cable, a diameter that is smaller than a diameter of the sheathed portion of the cable; and the cable core of the cable, wherein the sheathed cable is elastically clamped by compression in the second sub-section of the through-bore, and wherein solder is disposed in the slot to conductively connect the cable core to the contact part and secure the cable core to the body.

18. The assembly as recited in claim 17, wherein the at least one cable core comprises at least two cable cores are respectively received in at least two through-holes of the soldering aid, and are in each case elastically clamped by compression in the second sub-section of the respective through-bore.

19. A method for attaching the cable core of the cable to the conductor area, the method comprising:

producing the assembly according to claim 17, wherein the solder is molten and then solidified to conductively connect the cable core to the contact part and secure the cable core to the body; and attaching the contact part of the soldering aid to the conductor area.

20. The method according to claim 19, wherein the solder is introduced into an opening at the top of the slot.

21. A soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, wherein the through-bore has a step in an insertion direction of the cable core of the cable from a second sub-section to a third sub-section of the through-bore, the third sub-section having a diameter that is smaller than a diameter of the sheathed portion of the cable and larger than a diameter of the cable core of the cable, and wherein the through-bore has, at least in a first sub-section of the through-bore, a diameter that decreases away from an insertion opening, and wherein the through-bore has, in at least the second sub-section of the through-bore disposed after the first sub-section in an insertion direction of the cable core, a diameter that is smaller than the diameter of the sheathed portion of the cable.

22. An assembly comprising:

a soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, and wherein the through-bore has a step in an insertion direction of the cable core of the cable from a second sub-section to a third sub-section of the through-bore, the third sub-section having a diameter that is smaller than a diameter of the sheathed portion of the cable and larger than a diameter of the cable core of the cable; and the cable core of the cable, wherein the cable is received in the through-bore such that an end of a sheath of the sheathed portion of the cable rests against the step, and wherein solder is disposed in the slot to conductively connect the cable core to the contact part and secure the cable core to the body.

23. A method for attaching a cable core of a cable to a conductor area, the method comprising:

producing the assembly according to claim 22, wherein the solder is molten and then solidified to conductively connect the cable core to the contact part and secure the cable core to the body; and attaching the contact part of the soldering aid to the conductor area.

24. A soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, wherein the contact part is substantially U-shaped or Z-shaped in profile having a first leg and a second leg, the bottom of the slot being received between the first and second legs, and wherein the contact part is substantially U-shaped in profile.

25. An assembly comprising:

a soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, and wherein the contact part is substantially U-shaped or Z-shaped in profile having a first leg and a second leg, the bottom of the slot being received between the first and second legs; and the cable core of the cable, wherein the cable is received in the through-bore such that the cable core is parallel to and electrically contacts the first leg of the contact part along a length of the first leg in an insertion direction of the cable, and wherein solder is disposed in the slot to conductively connect the cable core to the contact part and secure the cable core to the body.

26. A method for attaching a cable core of a cable to a conductor area, the method comprising:

producing the assembly according to claim 25, wherein the solder is molten and then solidified to conductively connect the cable core to the contact part and secure the cable core to the body; and attaching the contact part of the soldering aid to the conductor area.

27. A soldering aid for electrically conductively connecting a cable core of a cable to a conductor area, the soldering aid comprising:

a body made of an electrically insulating material and being formed as a single piece; and an electrically conductive contact part received in the body, the contact part having a contact surface configured to electrically conductively contact the conductor area, wherein the body is formed with a receptacle having a slot open toward one side configured to receive the cable core of the cable, and is formed with a through-bore configured to surround a sheathed portion of the cable, wherein the contact part closes an opening at a bottom of the slot and conductively contacts the cable core, wherein the through-bore has, at least in a first sub-section of the through-bore, a diameter that decreases away from an insertion opening, wherein the through-bore has, in at least a second sub-section of the through-bore disposed after the first sub-section in an insertion direction of the cable, a diameter that is smaller than a diameter of the sheathed portion of the cable, and wherein the opening at the bottom of the slot is formed as a longitudinal slot having a lengthwise extent that is more than about 2.5 times a diameter of the cable core.

* * * * *